US005583628A

United States Patent [19]

Parks

[11] Patent Number: 5,583,628

[45] Date of Patent: Dec. 10, 1996

[54] COPYING MACHINE HAVING AN ACTIVE STAPLE REMOVING APPARATUS

[75] Inventor: Bruce J. Parks, Bloomfield, N.Y.

[73] Assignee: Xerox Corporation, Stamford, Conn.

[21] Appl. No.: 584,588

[22] Filed: Jan. 11, 1996

[51] Int. Cl.[6] ..... G03G 15/00; B25C 11/00

[52] U.S. Cl. ..... 355/308; 227/63; 254/28; 355/324

[58] Field of Search ..... 355/308, 309, 355/324; 227/63; 254/28

[56] References Cited

U.S. PATENT DOCUMENTS

| | | | |
|---|---|---|---|
| 2,033,050 | 3/1936 | Pankonin | 227/63 X |
| 3,162,423 | 12/1964 | Hall et al. | 254/28 |
| 3,528,643 | 9/1970 | Munson et al. | 227/63 X |
| 4,473,220 | 9/1984 | Hovens et al. | 270/53 |
| 4,903,945 | 2/1990 | Wang | 254/28 |

FOREIGN PATENT DOCUMENTS

| | | |
|---|---|---|
| 6-186809 | 7/1994 | Japan . |
| 6-186807 | 7/1994 | Japan . |
| 6-186808 | 7/1994 | Japan . |

*Primary Examiner*—Matthew S. Smith
*Attorney, Agent, or Firm*—Tallam I. Nguti

[57] ABSTRACT

A convenience staple removing station in a portion of a frame of a reproduction machine for effectively and safely removing staples from a stapled set of document sheets. The staple removing station includes a recess and a tray for automatically receiving staples removed from stapled sets of document sheets. Importantly, the staple removing station includes an active movable staple removing apparatus including an actuatable movable staple extraction member having staple engaging tips for engaging, and applying a normal force to, a clinched staple in a stationarily positioned set of sheets, thereby pulling and removing the staple from the stationarily positioned set of sheets. The active staple removing apparatus further includes staple stripping members for automatically stripping and removing removed staples from the staple extraction member.

12 Claims, 6 Drawing Sheets

COPYING MACHINE HAVING AN ACTIVE STAPLE REMOVING APPARATUS

BACKGROUND OF THE INVENTION

This invention relates to electrostatographic copying machines, and, in particular, to such a machine including convenient staple removing station having an active and safe staple removing apparatus for removing and retaining staples from a staple set of document sheets.

Copying or reproduction machines include but are not limited to electrostatographic process machines. Generally, however, the process of electrostatographic copying or reproduction machines, such as light lens or scanner type machines, includes uniformly charging an image frame of a moving photoconductive member, or photoreceptor, to a substantially uniform potential, and imagewise discharging it or imagewise exposing it to light reflected from an original image being copied or reproduced. The result is an electrostatically formed latent image on the image frame of the photoconductive member. For multiple original images, several such frames are similarly imaged. The latent image so formed on each frame is developed by bringing a charged developer material into contact therewith. Two-component and single-component developer materials are commonly used. A typical two-component developer material comprises magnetic carrier particles, also known as "carrier beads," having fusable charged toner particles adhering triboelectrically thereto. A single component developer material typically comprises charged toner particles only.

In either case, the fusable charged toner particles when brought into contact with each latent image, are attracted to such image, thus forming a toner image on the photoconductive member. The toner image is subsequently transferred at a transfer station to an image receiver or copy sheet. The copy sheet is then passed through a fuser apparatus where the toner image is heated and permanently fused to the copy sheet forming a hard copy of the original image.

Original documents to be copied one by one at such a copying machine frequently come in the form of a stapled set, fastened together at least in one spot, by a staple. As is well known, the fastening staple has a crown portion and leg portions that pierce through the set of document sheets from a first side, and are then clinched or bent against the second or opposite side of the set of document sheets. A copying machine operator usually has to remove the staple or staples from the set of document sheets before copying each such document sheet, usually one by one.

For removing such staples, hand held staple removers of the type disclosed, for example, in U.S. Pat. No. 4,903,945, usually are used. Typically, an area of the top panel of the copying machine, occasionally including a shallow dip or surface recess, is used as a working surface for removing such staples using the hand-held staple remover. Ordinarily, there is a problem with removed and loose staples when they are carelessly left in this area on the machine, even in the shallow surface recess. Such loose staples can cause even more problems if they drop into the machine operating area.

As disclosed in U.S. Pat. No. 4,473,220 attempts to solve the above problems have included, for example, a passive fixed position finger that has a sharp tip projecting over a tray in a recess, as well as, projecting upwardly above the surrounding surface for removing staples from stapled sets. Such upward projection of the sharp tip of the finger is obviously not very safe. To remove a staple using the finger, an operator must manually position, and then push a stapled set of sheets over the tip of the finger so that the sharp tip engages and horizontally prys the staple from the set The finger tip is towards its end in order to cause the staple, if properly engaged, to be pried free or removed from the stapled set.

Unfortunately, however, this finger staple remover will tend to leave the removed staple still clinging onto the finger, as is commonly the experience with hand-held staple removers of the sort. This finger also utilizes unopposed horizontal shearing forces for prying the staple. The shearing forces understandably will tend to cause the staple to rip or tear the sheets, particularly since the force to be provided is by the push of an operator with no guidance.

SUMMARY OF THE INVENTION

In accordance with the present invention, there is provided a convenience staple removing station in a portion of a frame of a reproduction machine for effectively and safely removing staples from a stapled set of document sheets. The staple removing station includes a recess and a tray for automatically receiving staples removed from stapled sets of document sheets. Importantly, the staple removing station includes an active movable staple removing apparatus including an actuatable movable staple extraction member having staple engaging tips for engaging, and applying a normal force to, a clinched staple in a stationarily positioned set of sheets, thereby pulling the staple from the stationarily positioned set of sheets. The active staple removing apparatus further includes staple stripping members for automatically stripping and removing removed staples from the staple extraction member.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 8:
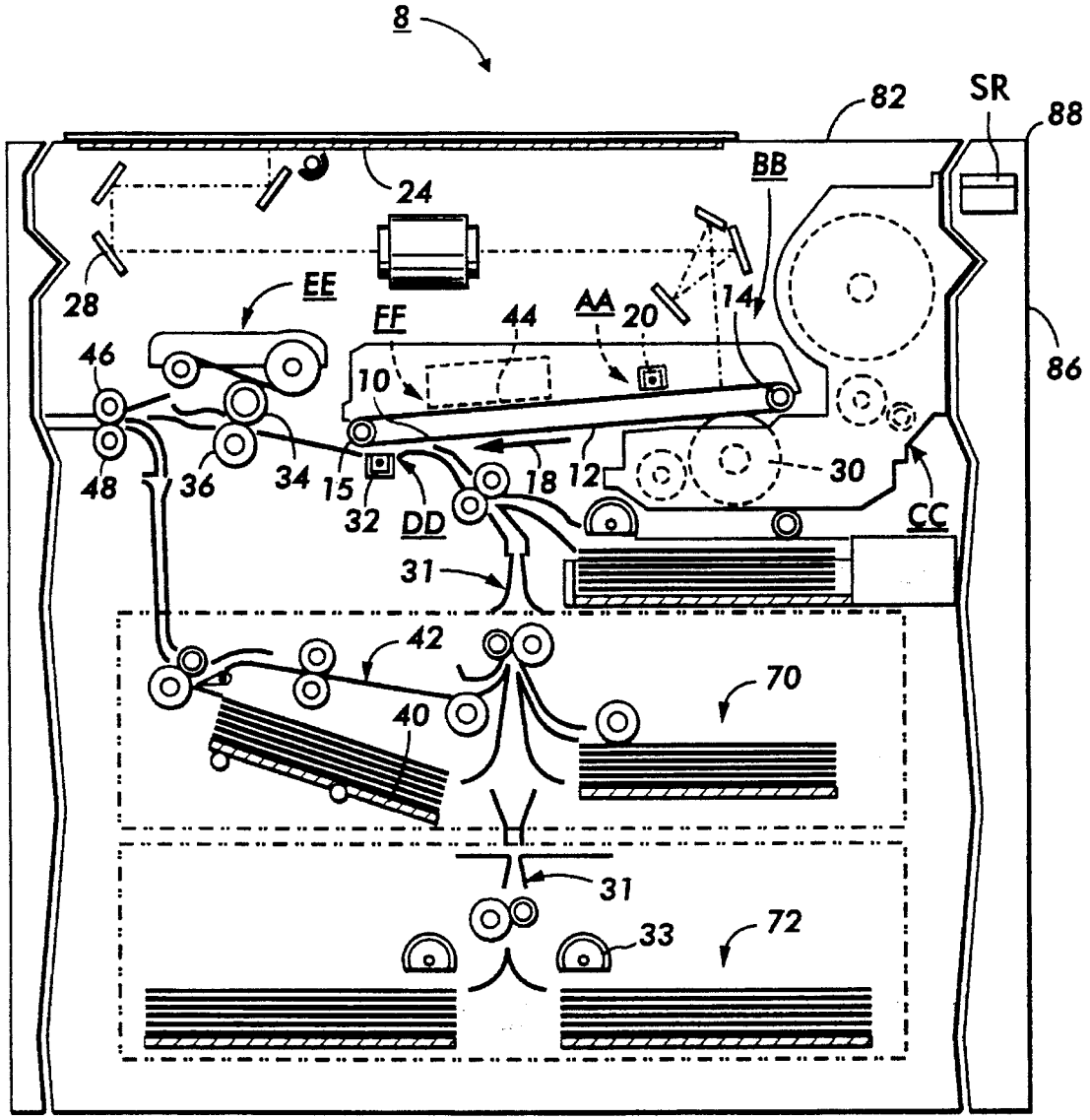
FIG. 8 is a vertical schematic view of the internal process components and stations of the copying machine of FIG. 1.

Referring first to FIG. 8, an exemplary electrostatographic reproduction machine 8 according to the present invention is illustrated. As shown, the machine 8 has conventional imaging processing stations associated therewith, including a charging station AA, an imaging/exposing station BB, a development station CC, a transfer station DD, a fusing station EE, and a cleaning station FF. Importantly, the machine 8 includes a convenience active staple removing station of the present invention shown generally as SR, (to be described in detail below).

As shown, the machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image is formed on the belt 10 corresponding to the image on a document positioned on a platen 24 via the light lens imaging system 28 of the imaging/exposing station BB. It will also be understood that the light lens imaging system can easily be changed to an input/output scanning terminal or an output scanning terminal driven by a data input signal to likewise image the belt 10. As is also well known, the document on the platen 24 can be placed there manually, or it could be fed there automatically by an automatic document handler device (not shown).

The portion of the belt 10 bearing the latent image is then transported to the development station CC where the latent image is developed by electrically charged toner material from a magnetic developer roller 30 of the developer station CC. The developed image on the belt is then transported to the transfer station DD where the toner image is transferred to a copy sheet fed from a sheet cassette tray, for example, sheet cassette tray assemblies 70, 72. As shown, the sheets are fed, for example, by a copy sheet handling system 31 that each includes a feed roller 33.

At the transfer station DD, a corona generating device 32 is provided for charging the copy sheet so as to attract the charged toner image from the photoconductive belt 10 to the copy sheet. The copy sheet with the transferred image thereon is then directed to the fuser station EE. The fuser apparatus at station EE includes a heated fuser roll 34 and backup pressure roll 36. The heated fuser roll 34 and pressure roll 36 rotatably cooperate to fuse and fix the toner image onto the copy sheet. The copy sheet then, as is well known, may be selectively transported to the finishing area, or to a duplex tray 40 along a selectable duplex path 42 for duplexing.

The portion of the belt 10 from which the developed image was transferred is then advanced to the cleaning station FF where residual toner and charge on the belt are removed by a cleaning device such as a blade 44, and a discharge lamp (not shown) in order to prepare the portion for a subsequent imaging cycle.

When not doing duplex imaging, or at the end of such duplex imaging, the copy sheets upon finally leaving the fusing rolls 34, 36, are passed to rolls 46 and 48 for input to the finishing area. From the input rolls 46, 48, the copy sheets are fed, for example, individually to an output tray 49, or to a bin sorter apparatus 50 where the sheets can be arranged in a collated unstapled set within the tray or within each bin 52 of the bin sorter apparatus 50.

Figure 1:
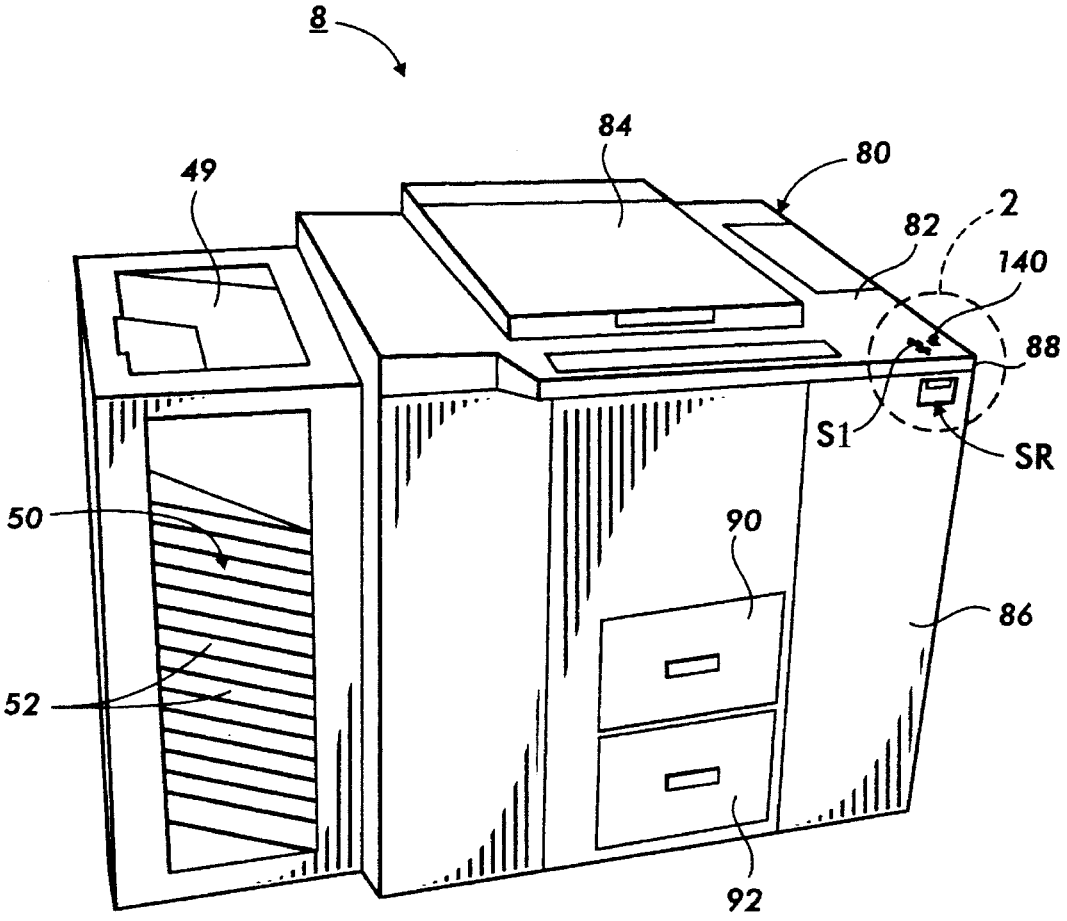
FIG. 1 is an external view of a copying machine including the active staple removing apparatus of the present invention.

Referring now to FIG. 1, the copying machine 8 is illustrated externally to show an exemplary location of the convenience active staple removing station SR of the present invention. Externally, the copying machine 8 includes a frame shown generally as 80 including a top horizontal frame panel 82. The top horizontal panel 82 includes a platen cover 84, and could instead include an automatic document handler (not shown), as well as an output tray 49. Copies of original documents reproduced by the process of the machine 8 can be collected as described above in a bin sorter apparatus 50 having individual bins 52. The frame 82 also includes a front vertical panel 86 that has openings for copy sheet supply trays 90, 92, for example, and that forms a corner 88 with the top horizontal panel 82. As illustrated, the convenience active staple removing station SR is preferably located in the corner 88.

Figure 2:
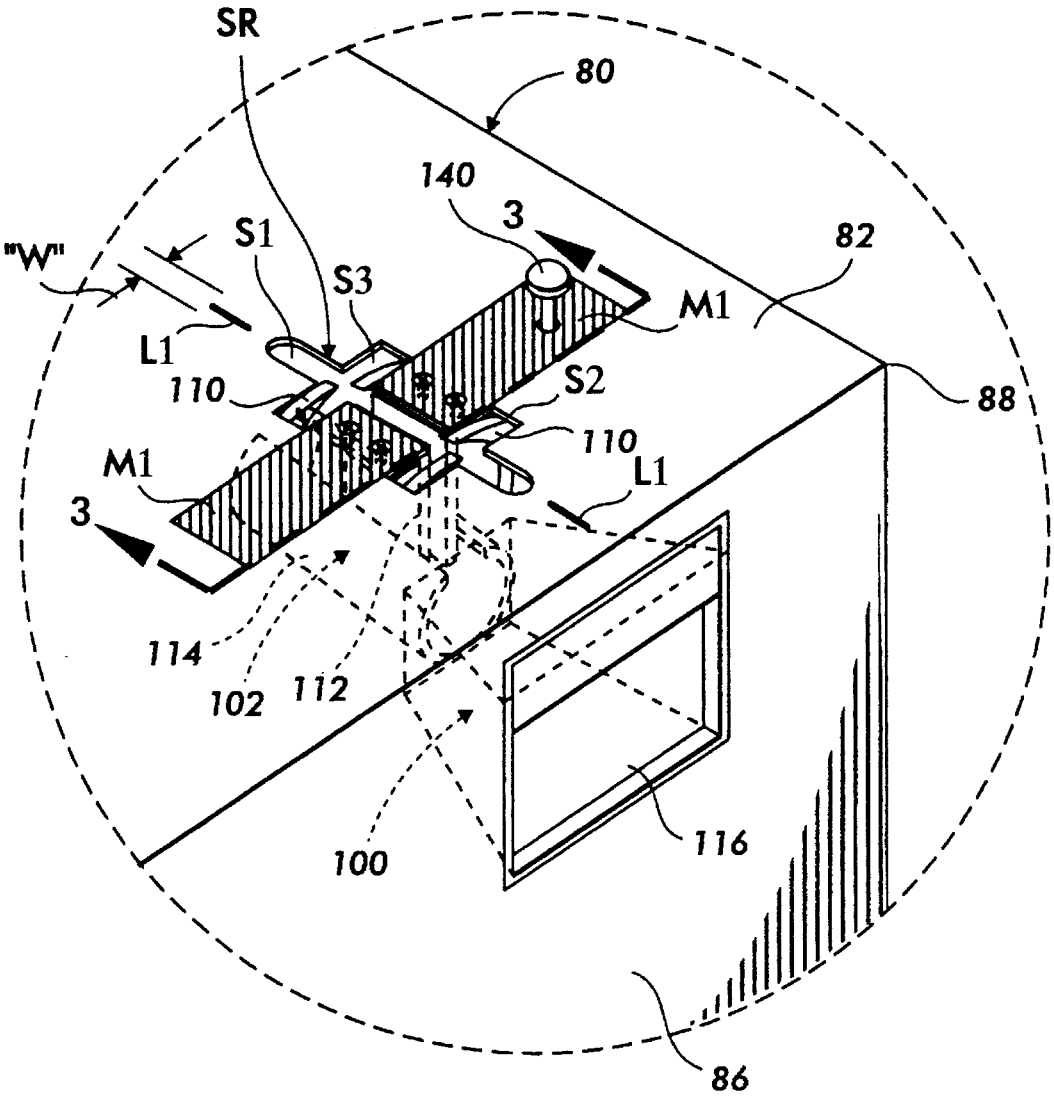
FIG. 2 is an enlarged view of the staple removing station (circled area 2) of the copying machine of FIG. 1.

Referring in particular to FIG. 2, the convenience active staple removing station SR of FIG. I is illustrated in enlarged detail. As shown, the staple removing station SR includes a recess 100 for containing the staple removing apparatus 102 of the present invention. In the top horizontal panel 82, the station SR includes a staple crown receiving slot S1, and at least a tool slot S2 each of which opens into the recess 100. Here, a pair of tool slots S2, S3 are preferably provided. The staple crown receiving slot S1 preferably has a width "w" that is barely wider than the diameter of a standard paper or sheet staple wire. The length of the staple receiving slot S1 preferably is equal to the standard length of the crown portion of a clinched staple used to bind a set of sheets. The slot S1 is cut into the plane of, and through the top horizontal panel 82, such that an operator placing a thumb or finger directly on the clinched legs of a staple binding a set of sheets, can without much effort guide the crown portion of the same staple (on the opposite of the clinched legs) into the slot S1.

To assist the operator in initially aligning the crown of the staple to the slot S1, the top horizontal panel 82 includes a painted band or mark M1 on either side of the slot S1 that is significantly wide enough for an operator to see, and is centered relative to the length of the slot S1. The top panel also includes a painted line L1 on either end of the slot S1 representing an approximate alignment for the axis of the crown of the staple being removed. In accordance with the present invention therefore, and regardless of the particular orientation of the clinched staple at a corner or at an edge of a set of sheets, the operator can generally align both the length and axis of the staple to be removed, to the mark M1 and line L1 around the slot S1. With a thumb or finger tip on the clinched legs of the staple on one side, the operator should easily sense the crown of the staple on the opposite side slip into a lodging position within the slot S1.

The tool slots S2, S3 run orthogonally to the crown receiving slot S1, and are spaced apart along the length of the slot S1. The top surfaces of slots S2, S3 as well as that of slot S1, are flush with the surface of the top horizontal panel 82. For safety reasons, the slots S2, S3 are just wide enough to freely receive the staple engaging tips 110 of the staple removing apparatus 102 of the present invention. Within the recess 100, and directly below the crown receiving slot S1, the staple removing apparatus 102 includes removed-staple stripping bars 112, a removed-staple slide chute 114, and a removed-staple catch tray 116. As shown the tray 116 is removably and reinstallably located within the recess 100 for access through the front vertical panel 86 of the machine 8.

Figure 3:
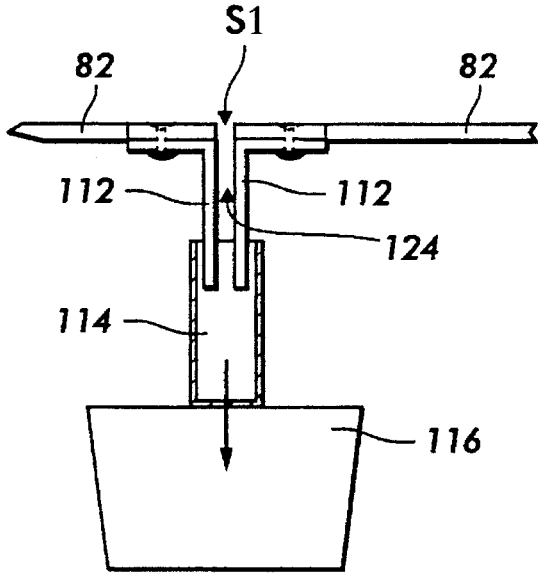
FIG. 3 is a schematic vertical front view of a staple stripping and collecting device of the staple removing apparatus of the present invention.
Figure 4:
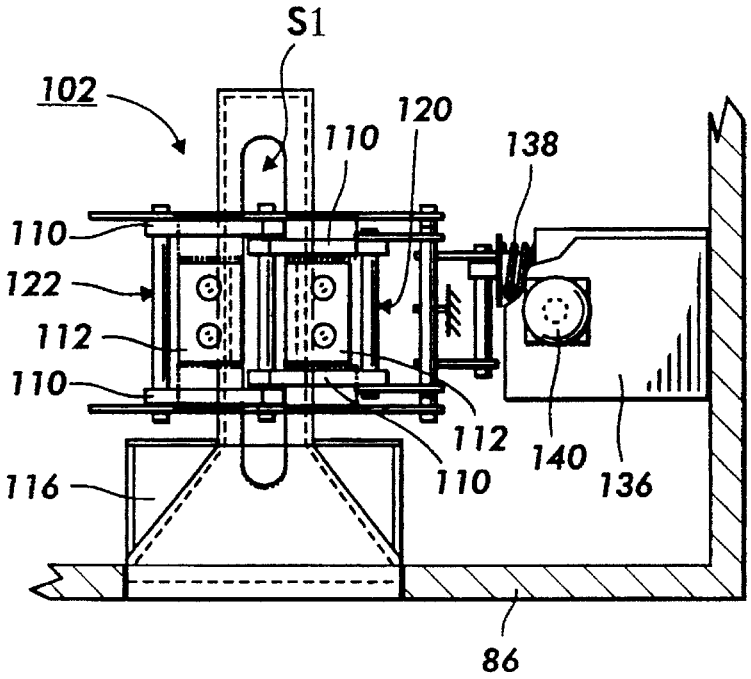
FIG. 4 is a schematic top view of the staple removing station of FIG. 2 showing the staple removing apparatus of the present invention.

Referring now to FIGS. 3–4, the removed-staple stripping members 112, for example, are L-shaped thin bars that are attached as by screws, and in an inverted manner to the top horizontal panel 82 of the machine frame. The stripping bars 112 are attached as such between the two staple engaging tips 110 of each staple extraction member 120, 122 of the staple removing apparatus 102 (FIG. 4 top view). As further shown in FIG. 4, the staple engaging tips 110 of the staple extraction member 122 are wider apart than those of the extraction member 120. This arrangement, as will be explained below, allows the narrow tips 110 of the extraction member 120 to pivot in an overlapping manner between the tips 110 of the extraction member 122. As such, the stripping bar 112 on each side of the slot S1 is therefore preferably narrow enough to allow the narrower tips 110 of the extraction member 120 to pass on each end thereof.

The overlapping pivoting movement of the extraction members 120, 122, coupled with a flaring feature of their tips 110 combine to move a removed-staple downwards and away from the slot S1. As shown in FIG. 3, the stripping bars 112 are mounted spaced apart so as to form a drop channel 124 between them, and directly below the slot S1. A removed-staple being moved away, as above from the slot S1, therefore, is moved into the channel 124 between the bars 112. The channel 124 preferably is wider than the diameter of a standard staple wire so as to allow a removed-staple to drop gravitationally into the slide chute 114, from which it slides into tray 116.

Figure 5:
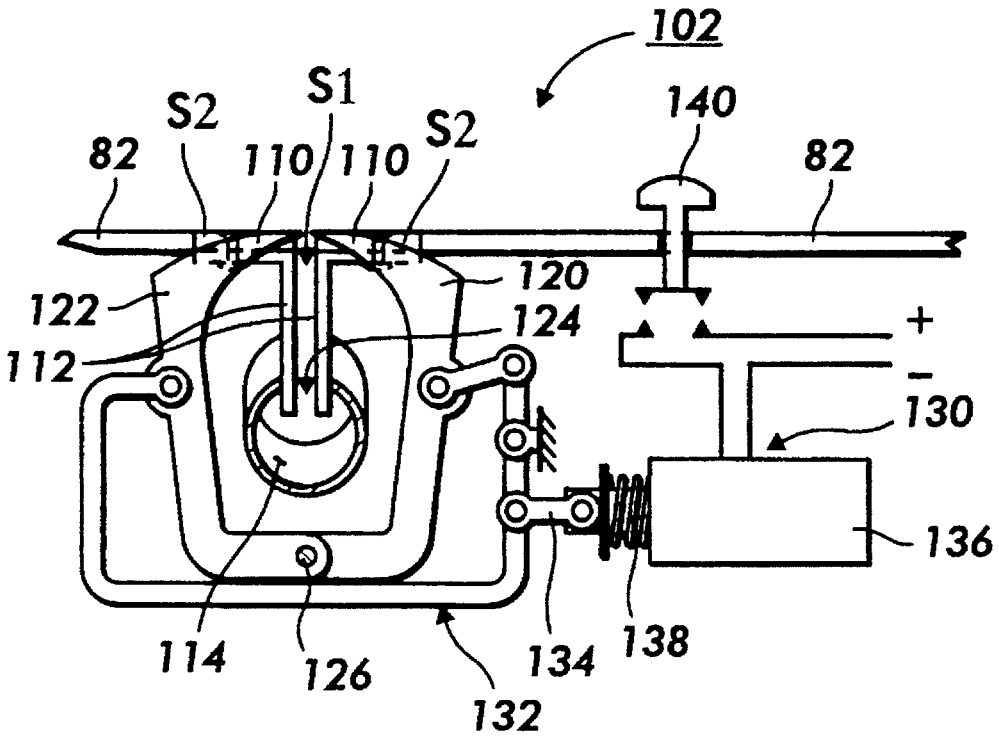
FIG. 5 is a schematic vertical front view of the staple removing station of FIG. 2 showing the staple removing apparatus of the present invention.
Figure 6:
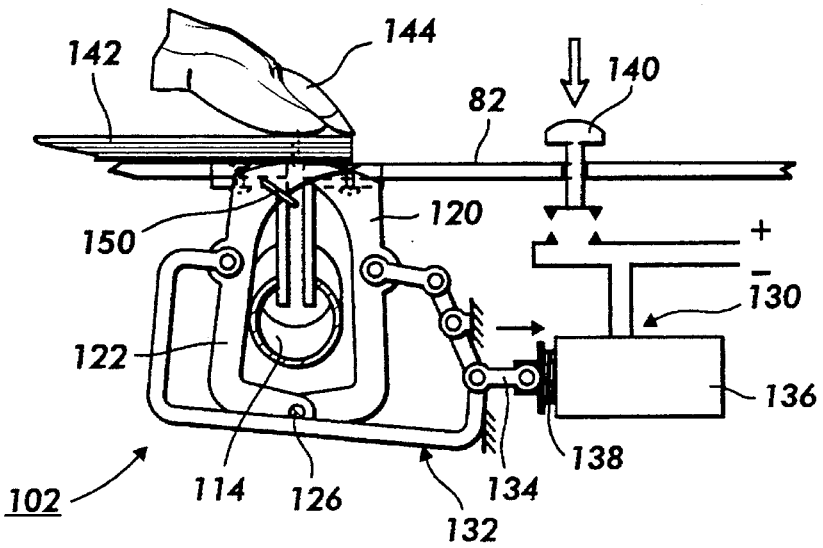
FIG. 6 is a schematic view of the staple removing station of FIG. 2 showing the staple removing apparatus in the closed, staple-removed position.
Figure 7:
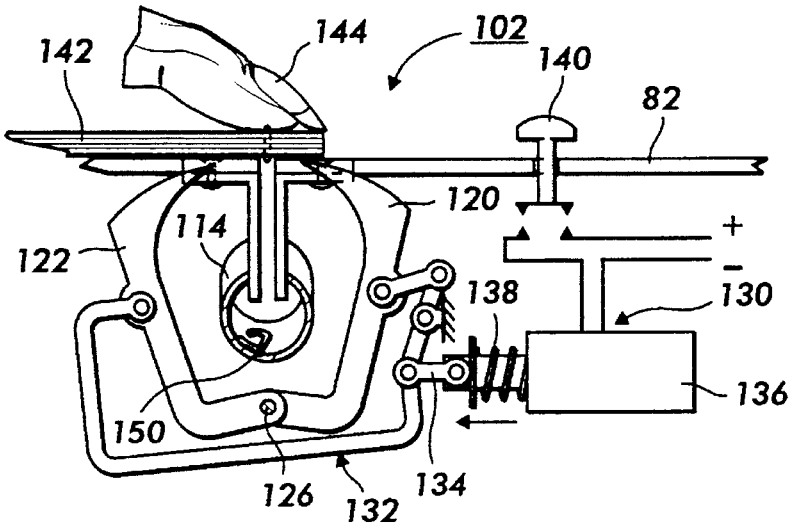
FIG. 7 is a schematic view of the staple removing station of FIG. 2 showing a removed-staple stripped from the staple extraction members.

Referring now to FIGS. 5–7, the staple removing apparatus 102 of the present invention is more fully illustrated. It is shown first in its off, and normally open position (FIG. 5), then in its staple removing closed position (FIG. 6), and finally back in its off and open position after removing a staple (FIG. 7). As shown, the apparatus 102 includes preferably a pair of movable, active staple extraction members 120, 122 that are hinged together at a pivot 126 at their second ends, respectively. Each extraction member 120, 122 includes a pair of spaced apart sharp staple engaging tips 110 (FIG. 4) at their first ends. The extraction members 120, 122 are movable pivotably about the pivot 126 into a closed and overlapping position (FIG. 6) centered over the staple drop channel 124. During such movement, the staple engaging tips move through the tool slots S2, S3 on either side of the staple slot S1. The pivot 126 is located at a distance below the slots S1, S2, S3, such that given a radius of rotation of the tips 110, such tips will never project above the surface of the top horizontal panel 82.

As further shown, an active drive assembly 130 is provided for actively moving the extraction members 120, 122 into a staple engaging position, then into a staple stripping position (FIG. 6) and finally back to its off and normally open position (FIG. 7). The active drive assembly 130 includes a linkage subassembly 132 connected to the extraction members or jaws 120, 122 as shown, and to a drive connection rod 134. Movement of the connecting rod 134 operates the extraction members by moving them between their open and fully closed positions. Drive power to the connecting rod 134 can, of course, be provided by a suitable device such as a mechanical actuator with a return spring (not shown), or a reversable gear train and motor assembly (also not shown), or an assembly of a solenoid 136 and a return spring 138. Electrical power is supplied to the solenoid by means of an actuator button 140.

As further illustrated in FIGS. 6 and 7, an operator desiring to remove a staple with clinched legs from a stapled set of sheets 142 will invert the set of sheets over the station SR and attempt to align the axis of the crown portion of the staple between the line marks L1, as well as, the length of the crown portion within the band mark M1 (FIG. 2). With the tip of a finger 144 on the clinched legs of the staple on the topside of the set of sheets being aligned, the operator will without much effort gently guide and feel the crown portion of the staple slip and lodge into the slot S1.

With the set of sheets stationary and the tip of the finger 144 still on the clinched legs of the staple, actuating the button 140 will move the extraction members 120, 122 towards each other until the tips 110 thereof engage the crown of the staple on both sides thereof within the slot S1. Engaging the crown of the staple on both sides as such prevents the sheet tearing action of horizontal, shearing forces from the tips 110 because the forces in one direction by one set of tips 110, are counteracted, or opposed by equal forces in the opposite direction. Advantageously, the net force of the tips 110 on the crown of the staple is therefore downwards. As shown in FIGS. 5–7, each tip 110 is flared away from its sharp point, therefore continued movement of each tip (after is engages the staple) into and across the slot S1 will cause the staple 150 (FIG. 6) to follow the flaring surface of each tip, and thus be pushed downwards and away from the set of sheets 142.

The stripping bars 112 and staple drop channel 124 are arranged directly below the slot S1, such that the staple 150 as pushed down by the tips 110, will be moved by the tips 110 directly into the channel 124. Such downward forced movement of the crown portion of the staple will cause the clinched portions of the legs to gradually flow open within and through the set of sheets into a more open position, and thus eventually free from, the set of sheets.

With the staple 150 lodged within the channel 124 and with its partially open legs still loosely in contact with the tips of the larger extraction member 122, a backward pivoting motion of the extraction members 120, 122 provided by the return spring 138, will cause the stripping bars 112 to retain the staple 150 within the channel 124, and hence remove or strip it from the backward moving tips 110. The staple 150 after being stripped from the tips 110 as such, is then free to drop gravitationally through the channel 124 into the inclined slide chute 114 (FIG. 7). In the chute 114, the staple 150 then slides into the collection tray 116, which is removable and reinstallable into the recess 100 through the vertical front panel 84.

To recapitulate, the present invention provides a convenience staple removing station SR in a portion of a frame 80 of a copying machine 8 for effectively and safely removing staples 150 from a stapled set of document sheets 142. The staple removing station SR includes a recess 100 and a collection tray 116 for automatically receiving staples 150 removed from stapled sets of document sheets. Importantly, the staple removing station SR includes an active movable staple removing apparatus 102 including at least an actuatable movable, active staple extraction member 120, 122 having staple engaging tips 110 for engaging, and applying a normal force to, a clinched staple in a stationarily positioned set of sheets, thereby pulling and removing the staple 150 from the stationarily positioned set of sheets. The active staple removing apparatus 102 further includes staple stripping members 112 for automatically stripping and removing removed-staples from the staple extraction member 120, 122.

As can be seen, there has been provided in accordance with the present invention, a copying machine having a convenience staple removing station including an active staple removing apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A reproduction machine for producing sheet copies of sheet original documents, the reproduction machine comprising:

(a) a machine frame;

(b) means supported within said machine frame including an image bearing member, for forming a toner image of an original image of a sheet document;

(c) means for transferring said toner image onto a copy sheet;

(d) means including a platen for holding and exposing an original image of a sheet original document onto said image bearing member; and (e) a convenience staple removing station built into a portion of said machine frame for effectively and safely removing clinched staples binding a set of sheet documents from a stapled set of sheet documents, said staple removing station including an active convenience staple removing apparatus having at least a movable staple extraction member having staple engaging means for engaging and removing clinched staples from a stapled set of sheets, and stripping means for stripping removed-staples away from said movable staple extraction member.

2. The reproduction machine of claim 1, wherein said stripping means includes a pair of thin stripper members positioned directly below a staple being removed, said thin stripper members being spaced from each other to form a drop channel for receiving staples removed by said staple extraction member.

3. The reproduction machine of claim 2, wherein said staple engaging means of said movable staple extraction member includes a pointed tip having an external surface flaring away from said pointed tip for deflecting a removed-staple into stripping engagement within the drop channel when said movable staple extraction member is moved backwards from a staple engaging position to an open position.

4. The reproduction machine of claim 1, wherein said convenience staple removing station includes a receiving slot through a top panel of said machine frame for receiving and lodging a crown of a staple being removed, and a pair of tool slots arranged orthogonally to said receiving slot for allowing free movement of said staple engaging means of said staple extraction members.

5. The reproduction machine of claim 4, including a set of marks on a surface of the top panel around said receiving slot for assisting an operator in aligning a crown of a staple for location and lodging into said receiving slot.

6. The reproduction machine of claim 1, wherein said convenience staple removing station having a pair of said movable staple extraction members including first and second staple extraction members arranged to move oppositely to each other so as to prevent sheet tearing by neutralizing staple engaging shear forces by each other.

7. The reproduction machine of claim 1, wherein said convenience staple removing station includes an inclined slide chute positioned below said stripping means for receiving removed-staples stripped from said staple extraction member, and a staple collection tray arranged for receiving removed-staples from said slide chute.

8. A staple removing apparatus for removing a staple binding a set of sheets from the set of sheets, the staple removing apparatus comprising:

(a) a movable staple extraction member having a movement path, a first end and a second end, said second end including a pointed tip for engaging a crown portion of the staple binding the set of sheets;

(b) means connected to said extraction member for moving said pointed tip reciprocally along said movement path into, and out of a staple engaging position; and (c) a staple stripping member mounted orthogonally relative to said movement path of said extraction member for intercepting and stripping removed-staples from said staple extraction member when said extraction member is being moved out of the staple engaging position.

9. The staple removing apparatus of claim 8, having a pair of said stripping members including a first and a second stripping members positioned directly below a staple being removed, said first and said second stripping members being spaced from each other to form a drop channel for receiving staples removed by said staple extraction member.

10. The staple removing apparatus of claim 8, having a pair of said movable staple extraction members including a first and a second staple extraction members arranged to move oppositely to each other so as to prevent sheet tearing by neutralizing staple engaging shear forces produced by each other.

11. The staple removing apparatus of claim 8, including an inclined slide chute positioned below said stripping members for receiving removed-staples stripped from said staple extraction member, and a staple collection tray arranged for receiving removed-staples from said slide chute.

12. The staple removing apparatus of claim 8, wherein said pointed tip has an external surface flaring away from said pointed tip for deflecting a removed-staple away from said second end of said staple extraction member when said staple extraction member is moved backwards from the staple engaging position to an open position.

* * * * *